US008439403B2

(12) United States Patent
Kittler, Jr. et al.

(10) Patent No.: US 8,439,403 B2
(45) Date of Patent: May 14, 2013

(54) PRINTED ARTICLE WITH SPECIAL EFFECT COATING

(75) Inventors: Wilfred C. Kittler, Jr., Rohnert Park, CA (US); Neil Teitelbaum, Ottawa (CA)

(73) Assignee: JDS Uniphase Corporation, Milpitas, CA (US)

( * ) Notice: Subject to any disclaimer, the term of this patent is extended or adjusted under 35 U.S.C. 154(b) by 1134 days.

(21) Appl. No.: 11/845,319

(22) Filed: Aug. 27, 2007

(65) Prior Publication Data

US 2008/0054623 A1 Mar. 6, 2008

Related U.S. Application Data

(60) Provisional application No. 60/823,774, filed on Aug. 29, 2006.

(51) Int. Cl.
*B42D 15/00* (2006.01)
*B42D 15/10* (2006.01)

(52) U.S. Cl.
USPC ..... 283/99; 283/72; 283/82; 283/94; 283/107; 283/109; 283/901

(58) Field of Classification Search ..... 281/51; 283/72, 79, 82, 93, 94, 99, 107, 109, 117, 283/901
See application file for complete search history.

(56) References Cited

U.S. PATENT DOCUMENTS

| | | | | |
|---|---|---|---|---|
| 4,022,928 | A | 5/1977 | Piwcyzk | |
| 4,652,015 | A | 3/1987 | Crane | |
| 4,749,591 | A | 6/1988 | Ronchi | |
| 5,364,689 | A | 11/1994 | Kashiwagi et al. | 428/195.1 |
| 6,114,018 | A | 9/2000 | Phillips et al. | 428/200 |
| 6,474,695 | B1 | 11/2002 | Schneider et al. | |
| 6,673,420 | B1 * | 1/2004 | Muller et al. | 283/72 |
| 6,838,166 | B2 | 1/2005 | Phillips et al. | 428/323 |
| 7,517,578 | B2 * | 4/2009 | Raksha et al. | 283/72 |
| 2003/0165637 | A1 | 9/2003 | Phillips et al. | |
| 2004/0047024 | A1 | 3/2004 | Mortarotti | |
| 2004/0109953 | A1 | 6/2004 | Kwasny | |

FOREIGN PATENT DOCUMENTS

| | | |
|---|---|---|
| DE | 2205428 | 3/1971 |
| DE | 10122836 | 5/2001 |
| EP | 0435029 | 5/1994 |
| EP | A-0624688 | 5/1994 |
| EP | 1 353 197 | 10/2003 |
| EP | 1669 213 A1 | 6/2006 |

(Continued)

*Primary Examiner* — Dana Ross
*Assistant Examiner* — Justin V Lewis
(74) *Attorney, Agent, or Firm* — Matthew A. Pequignot; Pequignot + Myers LLC

(57) ABSTRACT

A printed article is disclosed having a light transmissive substrate having a reverse printed region on a surface thereof in the form of a plurality of very closely spaced printed lines or regions. The printed regions and spaces therebetween are subsequently flood coated with special effect ink such as optically variable ink wherein the ink particle size is on average greater than the gap between reverse printed regions. The image is viewed from the non-printed side of the substrate and very fine lines of the special effect flood coated special effect ink appear as very clear sharp lines having a fine resolution. This eliminates the typical jagged edges that would otherwise be seen if the inked region was not present. This effect is due to the first printed inked regions or lines forming a mask through which the flood coated ink is seen.

20 Claims, 2 Drawing Sheets

FOREIGN PATENT DOCUMENTS

| | | |
|---|---|---|
| EP | 1 741 757 | 1/2007 |
| GB | 2119312 | 4/1983 |
| GB | 2347646 | 3/1999 |
| WO | WO 87 00208 | 1/1987 |
| WO | WO 02101147 | 12/2002 |
| WO | WO 02103624 | 12/2002 |
| WO | 2004/101890 | 11/2004 |
| WO | WO 2005/017048 | 2/2005 |

* cited by examiner

PRINTED ARTICLE WITH SPECIAL EFFECT COATING

CROSS-REFERENCE TO RELATED APPLICATIONS

The present invention claims priority from U.S. Provisional Patent Application No. 60/823,774 filed Aug. 29, 2006, which is incorporated herein by reference.

FIELD OF THE INVENTION

This invention relates generally to the provision of an optical device and method of manufacture, wherein a light transmissive substrate is printed with lines in the form of an image or indicia using an ink and wherein the inked substrate is subsequently coated with a special effect coating allowing the special effect coating to be seen between the printed lines.

BACKGROUND OF THE INVENTION

The use of security devices such as substrates coated with secure coatings for adhering to and for protecting banknotes, credit cards and other valuable documents is well known. Some of these security devices provide the advantage of being decorative as well. By way of example, however not limited thereto, a security thread is a strip of material placed on the surface of a banknote document or sheet such as banknote; alternatively a security thread may be serpentined or woven into the banknote paper (a window type effect) to confer additional security (authenticity) to the bank note. Typical dimensions of a hot stamp thread are a width of 1-5 mm, a thickness of 3-4 .mu.m; windowed polyester terephthalate (PET) based threads have a thickness of about 0.5 mil or 12.5 microns. By way of example, one of the earliest forms of security threads consisted of reflective foil transferred by hot stamping to the surface the banknote (GB 2119312 A). This reflective foil prevented reproduction of counterfeit banknotes by printing processes such as from printing presses, PC printers and copiers. Holograms (EP-A-0624688), holographic features along with thermo chromic features (GB 2347646), opaque coatings having characters and patterns readable by transmitted light in combination with luminescent substances (U.S. Pat. No. 6,474,695), repeating patterns of magnetic/magnetic indicia or metal dots (WO02103624), laser etching fine lines and text with a laser (German "Auslegeschrift" no. 22 05 428) and (WO02101147), printing micro-characters on a metalized transparent plastic with clear acid resistant inks followed by acid etching of the unprinted areas to produce shiny micro-characters on a transparent base (U.S. Pat. No. 4,652,015), bonded nucleic acid molecules so that complementary nucleic acid molecules can bind to the molecules already attached to the document (DE 10122836), and optically variable security elements using liquid crystal material (EP0435029) have all been used to make security threads. However, these aforementioned optical device either take too much time to make and or have other associated problems; for example, it is found that laser etching takes too long to be cost effective, etching by use of chemicals requires multiple steps and is not considered to be environmentally-friendly; holograms can be readily copied, and in many instances the features of these security devices are not readily seen by eye by the average person and machines are required to read them.

A method to pattern a single layer of metal or carbon in a vacuum chamber was advanced in U.S. Pat. No. 4,022,928 by Piwcyzk. Piwcyzk used various methods to apply a perfluoropolyether known as FOMBLIN™ or Krytox™ to a substrate requiring a pattern for a vacuum deposited layer. The perfluoropolyether inhibited the deposition of the depositing material to a web or plastic substrate. Application of this fluid was by spray or vacuum evaporation in combination with a selected removal process as with a laser or an electron beam. A printing method was also described for applying the perfluoropolyether. Printing techniques including relief printing such as letterpress or flexography, planographic printing such as offset lithography, and gravure, and screen-printing such as silkscreen process printing were disclosed.

Subsequently, Ronchi in U.S. Pat. No. 4,749,591 incorporated herein by reference, and in PCT application WO 8700208(A1)) advanced this printing process by applying the inhibiting oil, FOMBLIN, to a vacuum roll coater where patterning thin films on plastic substrates was desired.

A major impediment to providing several thin film layers, was residual oil remaining on the images and on non-patterned areas of the web. This residual oil was detrimental to further thin film coating since left over oil would cause "ghosting"; a process whereby the inhibiting oil is transferred to the back side of plastic film when roll coating, which in turn causes inhibiting oil to be transferred further down the web on the front side. Left over inhibiting oil also causes adhesion failures to subsequent thin film layers.

In an effort to overcome impediments related to using inhibiting oil in providing a windowed image other techniques have been considered which use optically variable coatings.

Optically variable inks or coatings are composed of optically variable pigments, suspended in an ink, paint, or coating vehicle which is typically a polymer resin and may also contain other pigments, dyes, and additives. Optically variable pigments, such as the vacuum deposited optical multilayer pigments SecureShift™, Chromaflair™ and OVP™ pigments from JDSU Corporation, mica based pearlescent pigments such as those available from Englehard, Merck and others, and liquid crystal pigments are dependent for their effects on the layered structure and orientation of plate-like particles. For this reason, rather large platelets, typically ranging in size from a few micrometers to about 100 micrometers are preferred. If the particles become too small they fail to orient properly, and the brightness, purity, and degree of color or brightness change effects are reduced. The average size of such particles is typically larger than about 5 microns.

The platelet form of optically variable pigments results in difficulty in the production of fine features in printing processes. The optically variable particles themselves have dimensions much larger than those of conventional ink pigments which on average are smaller than 5 microns, and this leads to difficulty in dispersing the platelets and printing using conventional printing techniques. The printing of fine features requires that the pigment particles be significantly smaller than the feature size to be printed, so that the feature will appear to be continuous. This requirement is familiar from observation of displays composed of discrete elements, for example television and computer display screens, where picture features which approach the size of the display elements (pixels) become blurred and indistinct. There is a further problem with printing inks which have platelets larger than the desired feature size. Such platelets "bridge" across any closely spaced print regions of the printing plate, thus merging the regions in the printed article. Thus, even if the color shift areas are large compared to the platelet sizes, there can be no thin line boundaries between the color shift area and other printed features due to this bridging effect by the pigment particles.

One way in which these difficulties might be overcome, is to overprint fine contrasting and masking features on top of the optically variable ink features with a conventional fine particle ink. However, in practice it is not possible to get high print quality with this method, because the optically variable ink layer is thick, particularly in the case of magnetically oriented optically variable ink such as JDSU "Phantom™" ink, or mica-based pigmented inks, and the ink surface itself additionally may be quite rough due to the relatively large platelets embedded in the optically variable print region. Thus it is very difficult to overprint an optically variable ink pattern with a fine line closely controlled edge pattern. Close control of the placement, impression force, and consistency of ink application in a fine line pattern is not possible when printing on a non-planar surface.

The difficulties inherent in producing high resolution features using optically variable inks and coatings are overcome by the method of the present invention, in which the high resolution features are defined by printing with conventional inks, which comprise very fine or nanoparticulate pigments capable of printing high resolution features. The features are printed reversed on the substrate, leaving openings through which the optically variable component or layer may be viewed. Thus, it is only necessary for the optically variable layer to be printed behind the entire area which has openings for its viewing in the opaque print layer. In use, the article is viewed from the unprinted substrate side in the case of a transparent substrate, either as a label or printed article or as a hot stamp transfer to a receiving support article.

The optically variable component may be applied over the openings in the high resolution printed area either as an ink or coating, as optically variable pigment in an adhesive layer, or as a direct vacuum coated layer. Since the high resolution printed layer acts as a viewing mask when viewed from the substrate side, the optically variable component may be applied uniformly over the entire article, thus obviating the need for high resolution or fine features in the optically variable layer. Optionally, to conserve what may be costly optically variable ink or pigment, the optically variable component may be applied only to completely cover and overlap the open areas of the opaque ink mask.

Further, the application of the optically variable ink behind a conventional ink mask renders possible the production of individual items with unique content such as serial numbers, bar codes, images, and the like formed of optically variable effects by using for example inkjet, thermal transfer, or electrostatic printing methods to define the ink mask. Direct variable printing, especially at high resolution, is not practical with optically variable inks, due to their large particle size.

This invention provides security a decorative and/or security device which obviates the requirement of applying inhibiting oil and provides a simple means by which windows can be formed on a plastic substrate. In particular, a new optically variable security device having a high pattern resolution was made that contained readable text or graphic images where covert features could also be incorporated.

It is an object of this invention, to provide a security device having optically variable features such as an optically variable pattern that can be seen against a background that is distinguishable from the pattern, or from which the pattern stands out.

It is an object of this invention to provide a reverse printed image having gaps defined within the image defining windows, printed directly upon a light transmissive substrate, wherein gaps within the reverse printed image are coated thereover with a special effect coating of flakes, wherein the flakes can be seen through the substrate and wherein one of the reverse printed image and the flakes provide a background color for the other.

Special effect flakes include but are not limited to: color shifting flakes, color switching flakes, diffractive flakes; reflective flakes, covert flakes carrying covert information; purposefully shaped flakes, for example uniformly shaped flakes; magnetic flakes; magnetically alignable flakes, flakes containing fluorescent light emitting and/or wavelength conversion phosphors which respond to illumination at a first wavelength and emit energy at another wavelength, and/or combinations thereof. Special effect coatings are coatings comprised of a carrier having special effect flakes therein wherein the carrier in combination with the flakes may provide a special effect.

SUMMARY OF THE INVENTION

In accordance with the invention, a security device is provided comprising: a light transmissive substrate supporting on a first side thereof, a plurality of printed regions, wherein spaces between some adjacent regions have a width $W_1$ that is less than or equal to $P_1$, and a special effect coating supported by the substrate and covering at least some of the spaces between the adjacent regions, wherein the special effect coating has an average particle size of greater or equal to 5 microns.

In accordance with the invention, there is further provided, an article incorporating a color shifting pattern or design comprising a light transmissive substrate, a high resolution pattern printed on one side of said substrate in which unprinted transparent areas are provided, and a color shifting ink, coating, or film applied over said high resolution ink pattern so as to be visible through openings absent of ink in the ink pattern from the unprinted side of the transparent substrate.

In accordance with the invention a method of forming a security device having a first side and a second side is provided comprising the steps of:

providing a light transmissive substrate;

printing an image having regions of ink separated by spaces that are not printed upon the light transmissive substrate; and, coating regions of the substrate with a special effect coating such that at least some of the non printed spaces are covered, wherein patterned inked regions are visible and the special effect coating is visible simultaneously, when viewing one side of the device.

In accordance with another aspect of the invention there is provided a security device comprising:

a light transmissive substrate;

a reverse inked image printed thereon, having printed regions adjacent to one another having un-inked spaced regions therebetween, wherein the width of the spaces between some regions is less than $W_1$; and, a coating of special effect flakes covering at least some of the spaces having a width of less than $W_1$, wherein the largest particle size of the special effect flakes is greater than $W_1$.

DETAILED DESCRIPTION

The term security device referred to hereafter is meant to include any form of identifier that can be used to authenticate the device; and although the device described hereafter can be used as a decorative label or cover it inherently provides a measure of security for authentication.

Figure 1:
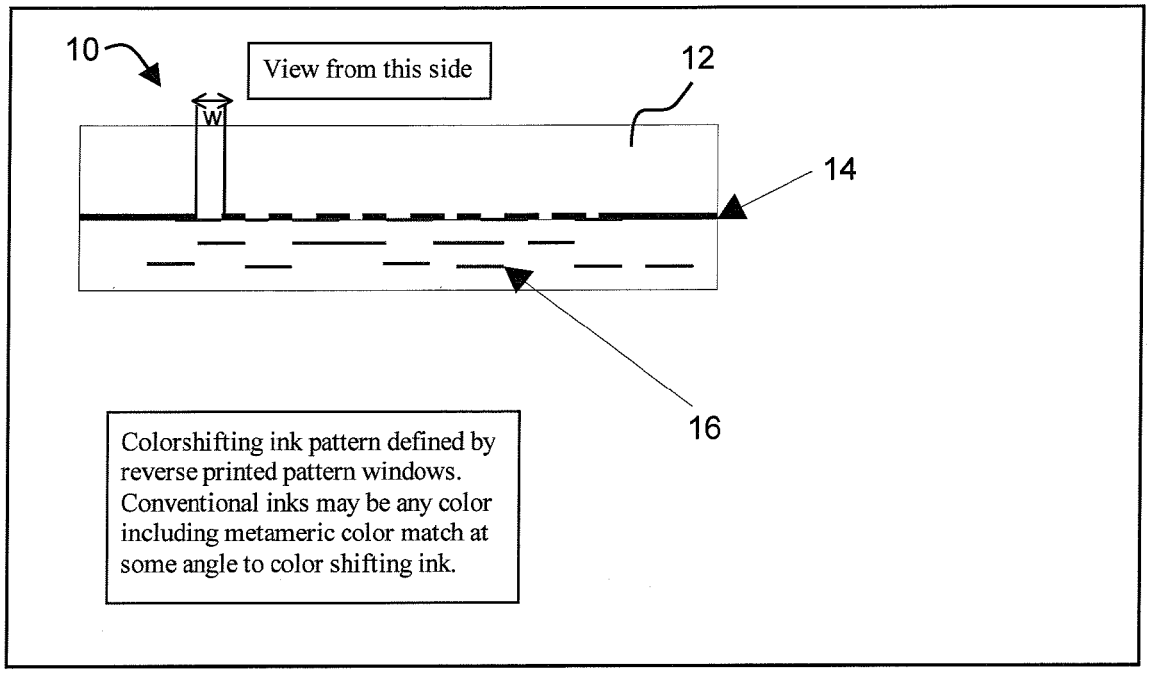
FIG. 1 is a cross sectional side view of a reverse printed image printed upon a light transmissive substrate, wherein the image is flood coated thereover with a color shifting pigment ink or adhesive.

Referring now to FIG. 1 a security device 10 is shown having a light transmissive substrate 12 that is transparent allowing an image placed on one side to be seen from the other side of the substrate. The substrate is shown as having two planar surfaces, however the upper surface may optionally have a microstructure not shown in the figure, such as a grating defined therein, spaced portions of the upper surface thereby providing diffractive effects in desired regions. In the manufacture of the device 10, a pattern 14 is reverse printed upon the lower surface of the transparent substrate 12 using conventional ink. The reverse printed image is printed so that the text or image appears readable when viewing it through the substrate. It is preferable that a particle size within the conventional ink be as small as possible so that adjacent printed regions can be separated by very thin, clear, unprinted regions without scalloped edges.

After the inked pattern 14 is applied to the substrate and the ink has dried, a portion or all of the inked image including gaps between inked regions is flood coated with color shifting ink or paint 16 having color shifting flakes 18 within a carrier. Alternatively, a color shifting adhesive having flakes therein may be used, for example a hot-stamp adhesive having color shifting flakes therein. Although color shifting flakes are coated over the dried non-color shifting inked pattern 14 as shown, color shifting flakes or any other special effect flakes can be used. Combinations of different special effect flakes may also be used. For example color switching flakes such as highly reflective aluminum flakes in a tinted carrier, or diffractive flakes, or covert symboled flakes or combinations thereof can be used to coat over the fine lined conventional inked pattern. The particular advantage in providing a transparent substrate printed with "conventional small platelet" printing ink coated thereover with special effect flaked ink is that a very crisp image having what appears to be very fine lines of special effect ink or paint is seen when looking through the substrate. Such visually apparent fine lines of special effect flaked pigment seen through a fine lined mask could not otherwise be provided by printing the visible pattern with the special effect ink, as the flakes would be too large to allow fine line spaces therebetween. Stated differently, if one reverses the process and first prints the fine line pattern with conventional special effect color shifting flakes ranging in size from 5 to 100 microns, and subsequently coats the printed image with conventional printing ink, the image would not appear as crisp to the viewer and scalloped edges would be much more evident in the image. In the embodiment shown, it is important that the smaller particle size ink be used upon the substrate subsequently coated with large size pigment flakes. There is only one instance where the order of coating is of little or no consequence. That is in an embodiment where the fine lined coating is printed on a first viewing side of the substrate and wherein the flood coated special effect ink or paint is coated on a second opposite side of the light transmissive substrate. However, this embodiment is less preferable than applying the special effect ink directly upon the conventionally reverse inked printed image. Depending on the thickness of the substrate there may be a visible parallax between the coating layers. If spot printing of color shift in areas of windows is used, printing on the two sides of the substrate would have to be in registration which is an additional requirement. Furthermore, in this less preferred embodiment preventing abrasion or weathering of the front surface ink which is not protected by the transparent substrate might require a protective coating or lamination which adds cost and process complexity. In this embodiment both sides of the substrate must be suitable for receiving ink, which might compromise other properties such as abrasion resistance which is desirable on the outward facing surface. In general, printing on both sides of the substrate is a more complex process.

Referring once again to FIG. 1, in an alternative embodiment, the color shifting ink or paint 16 can be selected such that it shifts from a first predetermined color to a second predetermined color, wherein one of the first and second colors matches the color of the inked pattern 14. Thus, by tilting the image, the color shifting ink 16 is either distinguishable from the inked pattern 14, or closely matches the pattern 14. It should be understood that in this embodiment, when the printed coated image is viewed through the substrate, it appears as if the inked region and color shifting inked regions are side-by-side, although the color shifting coating is coated over the entire conventionally inked printed region and covers spaced therebetween.

Figure 2:
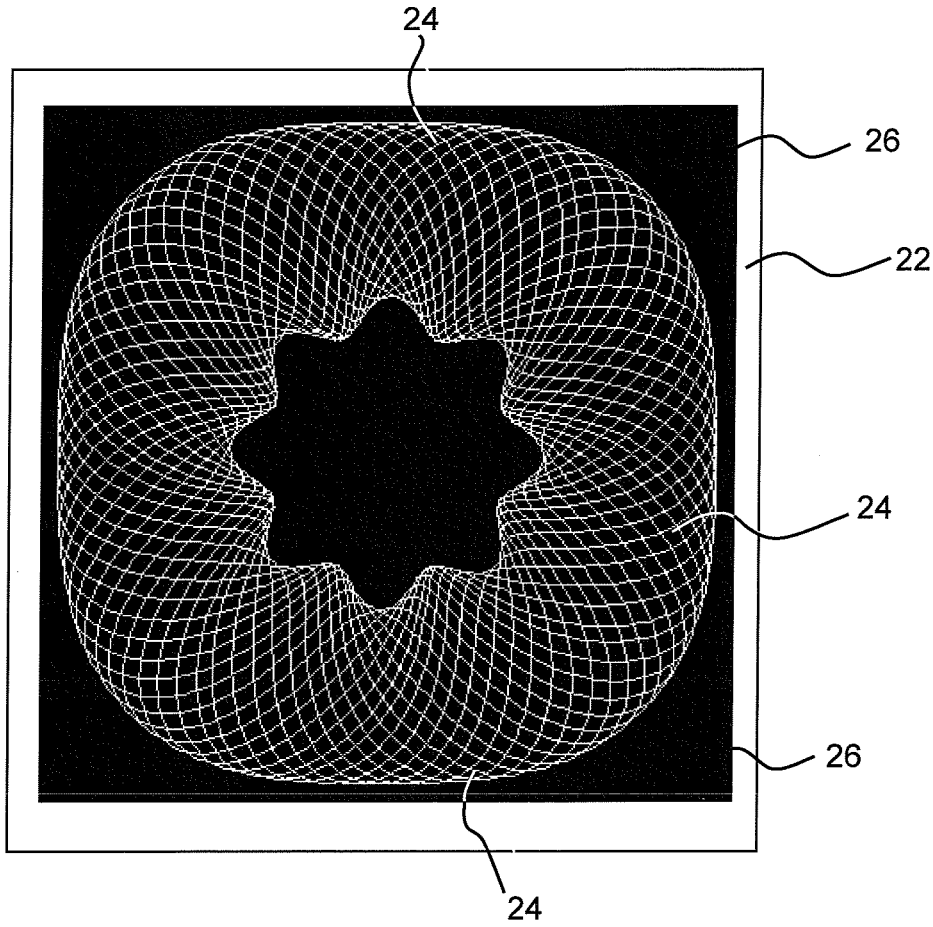
FIG. 2 is a plan view of an image having fine lines printed on one side of a substrate and having a flood coat of special effect flakes thereover.

In the embodiment shown in FIG. 2 a more complex image is shown, having a design of very even spaced fine printed lines 24 printed with conventional ink upon a substrate 22. A flood coat of highly reflective flakes 26 is printed over the lines 24 covering both the lines and fine spaces therebetween. By appropriately choosing the line width and width of spaces therebetween, a grating is formed having visible diffractive properties.

In another embodiment of the invention fine printed lines are provided on both sides of the substrate, either aligned or offset with each other. If the lines and spaces on both sides of the substrate are of a similar spacing and dimensions and suitably arranged compared to the thickness of a transparent substrate, a variety of variable image effects can be produced including something of a color-shifting and shape shifting moiré interference pattern due to the interaction of the two fine patterns as the substrate is tilted. Achieving such a moiré pattern or structure could not be done with coarse or fuzzy printed patterns alone, and also relies on the transparency of the substrate. In accordance with this invention the lines on the front (observer) side of the substrate must be printed with conventional ink with windows or alternatively a demetallized Al or other colored thin film layer(s). The opposite side would have a coating as described heretofore, wherein "apparently" fine lines of special effect ink are provided through a mask of conventionally printed ink having fine line gaps between regions.

A discussion of moiré patterns is found at http://en.wikipedia.org/wiki/Moir%C3%A9_pattern. The structure shown would require printing on both sides of the substrate so that the parallax gives the moiré a "motion". The effect can be illustrated by overlaying two layers of window screen and moving them linearly and rotating/tilting them.

To produce moiré effects the lines need not be straight, in fact the configuration of the lines and their interaction is a design parameter. In this case, moiré is a desired effect unlike in most printing where it is an undesirable artifact.

The device of FIG. 1 may be hot stamped to an article, for example to an identity card, currency a poker chip creating a decorative label that offers a high degree of security and which can be authenticated. Hot stamping is a coating system that is transferred from a support to the finished article, in which case the "transparent substrate" to which the printing is applied is the stamping release/coating layers carried on a support foil.

Although in preferred embodiments of this invention shown heretofore, reverse printing was utilized, in an alternative less preferred embodiment of the invention as mentioned above, the inked pattern can be printed on top of the substrate on the viewing side and the flaked coating of special effect flakes can be printed on the opposite non-viewing side of the device. An advantage of the preferred embodiment wherein the special effect coating is printed over the conventional reverse printed ink on the same side of the substrate is that no protective lacquer coating is required. In further embodiment the substrate may be printed over on the face side to incorporate security features such as tamper-evidence.

Further Advantages of the Invention

Additional advantages of applying the optically variable component behind a high resolution reverse printed ink layer which defines the optical variable viewing area are:

An optically variable ink tends to lie flat against the viewing aperture as it settles after application, thus giving more vivid and specular optical reflection.

If using a magnetically aligned optical effect ink, it may be applied thickly to permit out-of-plane orientation of the platelets, otherwise not consistent with fine features and sharp edges.

The overlying substrate (or hot stamp protective layer) provides inherent protection against the abrasion, chemical attack, or removal of the optically variable component—a further protection against alteration.

By virtue of the ability to sharply define small optically variable areas and patterns, smaller patches, labels, planchettes, and patterned threads may be made, for example for embedding in currency or value document paper.

Any appropriate printing method may be used to print the first-applied conventional ink print areas.

In addition to the use of reverse printing with optically variable inks, as discussed above, reverse printing may also be used to define viewing areas through which a directly deposited (for example by vacuum or solvent coating means) optically variable multilayer coating may seen. It is impractical and costly to directly pattern such coatings by lithographic means, especially as they are composed of multiple layers of different metals and dielectric materials, which often must each be etched by different processes.

Further, as well as acting as an opaque mask to define visible area of optically variable coating or ink, the reverse printed ink may also printed in various colors, including colors which contrast or match with the optically variable coating(s) visible through the apertures in the ink layer, thus forming a unified design or image or information bearing pattern of which the optically variable layer is one component. In particular, a hidden image or text composed of optically variable elements may be incorporated into a printed image by using small image elements (pixels) of optically variable coating or ink which are visible through windows in the conventionally printed image as described above.

In addition, the color of the optically variable pigment, and its optical shift, may be modified by the addition of further components to the ink, including dyes, conventional pigments, ultraviolet or infrared active phosphors, including infrared excited visible emitting and ultraviolet excited visible emitting materials, for example, while retaining the effect of optical variation and the advantages of the reverse printing method described above for the production of fine features.

Exemplary Embodiment

Black and white images containing a pattern of fine lines similar to those often used in security printing applications were chosen to demonstrate the invention. To produce the ink mask, the image was printed on overhead transparency film using a laser printer at an approximate resolution of 600 dots per inch. The results are images on transparent film comprised of a black field (laser printer deposited black toner ink) with the fine lines comprising transparent areas in the image. A sample of these images is shown in FIG. 4 as printed on white paper for better viewing. The white regions in FIG. 4 are unprinted and are transparent when printed on a light transmissive substrate in accordance with this invention. In an embodiment not shown, the substrate can be tinted to provide color to the coating of flakes.

To produce a color shifting image the non-viewing image bearing side of the substrate was covered with a layer of optically variable pigment in binder, by silk-screening a thin layer of 20% concentration of pigment in ink binder over the entire image area. When viewed from the non-inked side of the transparent substrate, a fine line color shifting pattern on a black laser printed background is obtained.

This exemplary embodiment demonstrates the basic principle of reverse printing to produce fine line images which cannot be directly printed, the use of digital imaging processes in conjunction with color shifting inks and coatings to produce images, and the use of variable image reverse image printed masks to produce individually coded color shifting features. Inkjet and thermal transfer printing may be incorporated into a printing line to produce the ink masks.

It is easily seen that by incorporating colored inks into the image in whole or in part to replace the black toner mask, that metameric and hidden color shifting information may be produced at high resolution by this process. Further, by incorporating continuous line printing techniques such as flexography and lithographic printing, fine and continuous features may be produced.

What is claimed is:

1. A printed article comprising:

a light transmissive substrate having a first-side surface and a second-side surface;

a first opaque coating supported on one of said first and said second-side surfaces, said first coating comprising a plurality of spaced apart opaque printed regions, said plurality of spaced apart printed regions defining spaces therebetween, wherein some of said spaces between said plurality of spaced apart printed regions have a width $W_1$ less than or equal to $P_1$; and a second coating, physically distinct from said first coating, said second coating supported on one of said first and said second-side surfaces, said second coating comprising a special effect coating including a carrier having a plurality of flakes disposed therein spanning at least some of said spaces between said plurality of spaced apart printed regions and covering at least part of one or more of said printed regions, wherein said plurality of flakes within said special effect coating have an average particle size of $P_1$ greater or equal to 5 microns; and wherein the first coating provides a masking function for hiding uneven or oversized flake edges contained in the second coating while simultaneously permitting viewing of special effect printed regions of the second coating through the spaces located between the spaced and opaque first printed regions of the first coating and wherein some of the spaces printed with the special effect coating appear to a viewer as thin lines.

2. A printed article as defined in claim 1 wherein the spaced apart printed regions are printed with an ink that has an average particle size of less than 5 microns.

3. A printed article as defined in claim 2 wherein the ink is an opaque ink and wherein the spaced apart printed regions are reverse printed regions.

4. A printed article as defined in claim 3 wherein each of the plurality of the spaced apart printed regions are comprised of dots of ink.

5. A printed article as defined in claim 2 wherein the special effect coating has an appearance which varies with a change in viewing angle.

6. A printed article as defined in claim 5 wherein the special effect coating is color shifting, color switching diffractive, or a combination thereof.

7. A printed article as defined in claim 2 wherein at least some of the flakes bear covert indicia.

8. A printed article as defined in claim 2 wherein $P_1$ is more than 10 microns and wherein the particles of the ink have an average size of less than 4 microns.

9. A printed article as defined in claim 2 wherein some of the spaced apart printed regions or some of the coated spaces between the spaced apart printed regions form a diffractive grating.

10. A printed article as defined in claim 9 wherein the first coating and the second coating are each supported on a same side of the substrate of one of the first and the second-side surfaces and wherein the printed article further comprises a plurality of printed lines supported on an opposite side of the substrate.

11. A printed article as defined in claim 2 wherein the printed article displays a moire pattern.

12. A printed article as defined in claim 2 wherein the first coating and the second coating are each supported on a same side of the substrate of one of the first and the second-side surfaces and wherein the printed article further comprises an additional distinguishing visible feature on an opposing side of the substrate.

13. A printed article as defined in claim 2 wherein the first coating and the second coating are each supported on a same side of the substrate of one of the first and the second-side surfaces and wherein the printed article further comprises a grating formed on an opposite side of the substrate.

14. A printed article as defined in claim 2 wherein the special effect coating serves as an adhesive.

15. A printed article as defined in claim 2 wherein the special effect coating includes special effect flakes in a carrier which serves as a dry hot stamp adhesive.

16. A printed article as defined in claim 2 wherein the flakes are special effect pigment flakes that are magnetically aligned.

17. A method of forming a printed article having a first-side surface and a second-side surface, the method comprising the steps of:

providing a light transmissive substrate;

printing a first coating comprising an opaque reverse printed image having regions of ink separated by unprinted spaces upon a region of the light transmissive substrate; and, coating the reverse printed image and unprinted regions of the substrate with a second coating, physically distinct from said first coating, the second coating comprising a special effect coating including a carrier having a plurality of flakes disposed therein, the second coating being applied such that at least some of the non printed spaces are covered with the flakes of the special effect coating, and at least some of the opaque first printed regions are at least partially covered with the flakes of the special effect coating; and wherein the first coating provides a masking function for hiding uneven or oversized flake edges contained in the second coating while simultaneously permitting viewing of special effect printed regions of the second coating through the spaces located between the spaced and opaque first printed regions of the first coating and wherein some of the spaces printed with the special effect coating appear to a viewer as thin lines.

18. A method as defined in claim 17 wherein the ink includes a plurality of particles and wherein an average size of the particles within the ink in the reverse printed image is at least two times smaller than an average size of the flakes in the special effect coating.

19. A method as defined in claim 17 wherein the reverse printed image defines an indicia.

20. A method as defined in claim 17, wherein the special effect coating is a color shifting, color switching diffractive, or a combination thereof.

* * * * *